US005678987A

United States Patent [19]

Timuska

[11] Patent Number: 5,678,987

[45] Date of Patent: Oct. 21, 1997

[54] ROTARY SCREW COMPRESSOR WITH VARIABLE THRUST BALANCING MEANS

[75] Inventor: Karlis Timuska, Spånga, Sweden

[73] Assignee: Svenska Rotor Maskiner AB, Stockholm, Sweden

[21] Appl. No.: 624,570

[22] PCT Filed: Oct. 10, 1994

[86] PCT No.: PCT/SE94/00947

§ 371 Date: Apr. 8, 1996

§ 102(e) Date: Apr. 8, 1996

[87] PCT Pub. No.: WO95/10708

PCT Pub. Date: Apr. 20, 1995

[30] Foreign Application Priority Data

Oct. 14, 1993 [SE] Sweden ..... 9303375

[51] Int. Cl.[6] ..... F04C 18/16; F04C 29/02

[52] U.S. Cl. ..... 418/97; 418/203; 418/DIG. 1

[58] Field of Search ..... 418/97, 203, DIG. 1

[56] References Cited

U.S. PATENT DOCUMENTS 3,932,073 1/1976 Schibbye et al. ..... 418/97
3,947,078 3/1976 Olsaker ..... 418/203
4,185,949 1/1980 Lundberg ..... 418/203
5,135,374 8/1992 Yoshimura et al. ..... 418/203

FOREIGN PATENT DOCUMENTS 1026165 4/1966 United Kingdom .

*Primary Examiner*—John J. Vrablik
*Attorney, Agent, or Firm*—Frishauf, Holtz, Goodman, Langer & Chick

[57] ABSTRACT

A rotary screw compressor having two rotors, liquid injection, a liquid separator (10), and a hydraulic thrust balancing piston (11) connected to at least one of the rotors. In order to vary the balancing force if suction and delivery pressures vary, there is provided first (5) and second (4) throttling devices in the return pipe from the oil separator to the liquid injection port. Between the first and second throttling devices there is a connection to a pipe branch (7) which ends in a cylinder (14) which houses the balancing piston (11). The balancing pressure acting on the balancing piston (11) will thereby vary as suction and delivery pressures vary in a way determined by the relation between the degree of throttling in the two throttling devices.

12 Claims, 1 Drawing Sheet

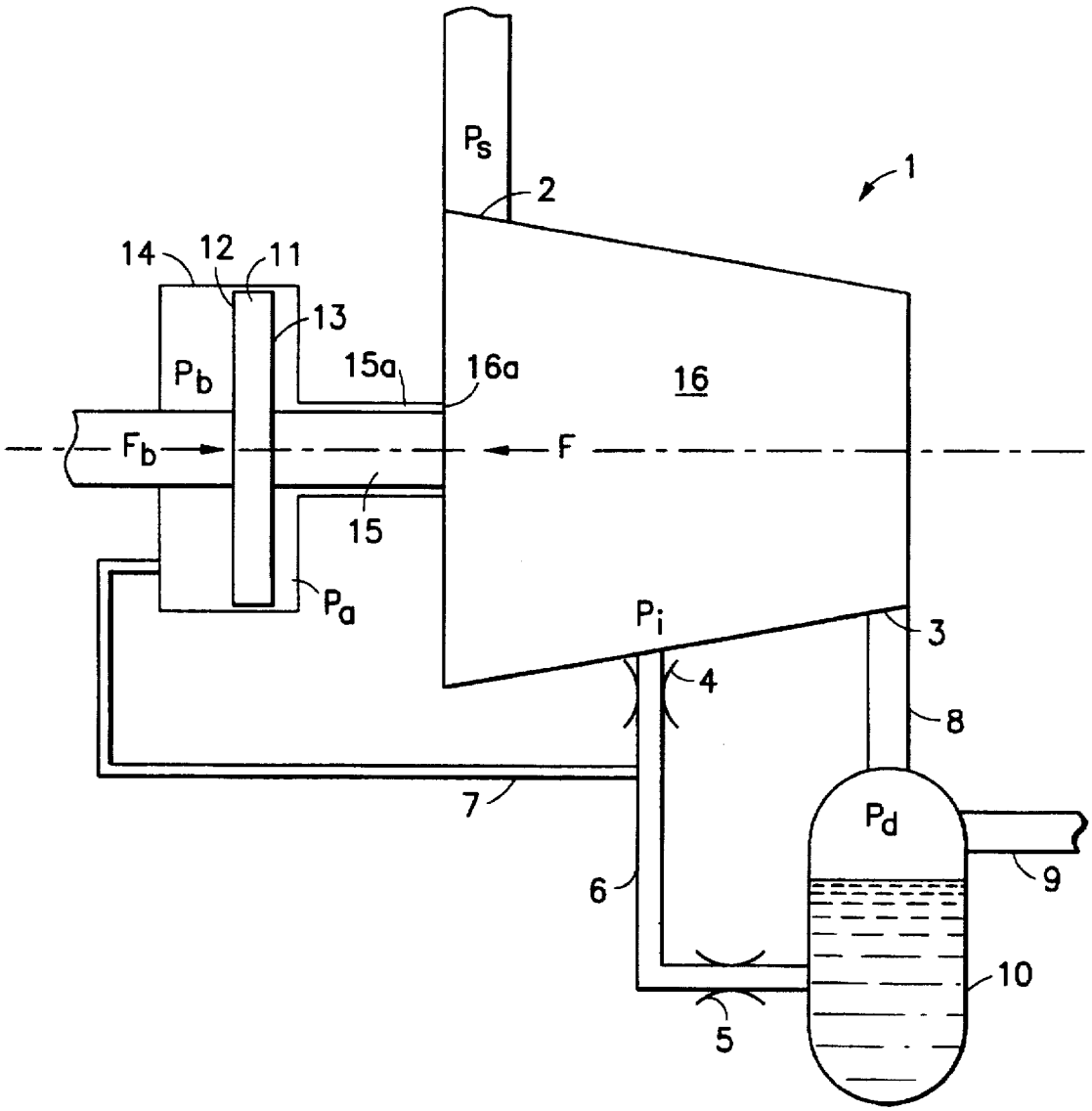
Ps
2
1
14
12
11
13
Pb
15a
16a
16
Fb
F
15
Pa
Pi
3
4
8
7
Pd
9
6
10
5

ROTARY SCREW COMPRESSOR WITH VARIABLE THRUST BALANCING MEANS

BACKGROUND OF THE INVENTION

The present invention relates to a rotary screw compressor of a kind wherein the axial gas forces acting on the rotors are counterbalanced by a thrust balancing piston in order to reduce a load on the thrust bearings. Compressors of this kind are disclosed for example in GB 1 026 165, U.S. Pat. No. 3,932,073 and U.S. Pat. No. 4,185,949.

Through the known devices an in normal cases appropriate reduction of the thrust load is attained. A problem, however, arises when the outlet pressure varies and in particular when also the inlet pressure varies. Under such working conditions axial gas forces will vary with the result that the rotor might be under- or overbalanced, depending on how the balancing piston is dimensioned and on the various working conditions. The result will be a decrease in the running life of the thrust bearings.

This problem is recognized in the above mentioned U.S. Pat. No. 3,932,073. That disclosure, however, does not present a complete solution to the problem, neither contains any claim related thereto, but only suggests in passing some measures that could be taken in order to overcome it. These measures include providing an expansion valve, which connects the high pressure side of the balancing piston with a closed working chamber in the compressor. The valve should be automatically opened or closed, and when open it creates a pressure drop over a throttling device between an oil separator and the balancing piston in a way not further described. The use of a control valve makes such an arrangement relatively complicated, and additional means probably also are required in order to realize the idea. The disclosure mentions this problem when the compressor is used in an automotive air condition apparatus, i.e. in an application where the pressure levels are quite low, and it is questionable if the arrangement would function in applications where the pressures are much higher.

The object of the present invention is to attain simple and reliable automatic adaptation of the thrust balancing force to various working conditions in a compressor in question, in particular for operating with high inlet and outlet pressures.

SUMMARY OF THE INVENTION

According to the present invention, a rotary screw compressor (1) comprises a pair of rotors operating in a working space (16) connected to a low pressure inlet port (2) and to a high pressure outlet port (3); a liquid injector (4) which injects a liquid into the working space at an intermediate pressure level; a liquid separator (10) connected to the outlet port; and a first pipe (6) including the liquid injector (4), the first pipe (6) connecting the liquid separator (10) to the working space (16) at the intermediate pressure level. A hydraulic thrust balancing piston (11) acts on at least one of the rotors. First (5) and second (4) throttling devices are provided in the first pipe (6); and a second pipe (7) is provided for connecting a first pressure surface (12) of the piston (11) to the first pipe (6), the connection to the first pipe (6) being located between the first (5) and second (4) throttling devices.

Preferably, each of the first (5) and second (4) throttling devices comprises a non-variable throttling device.

An arrangement according to the present invention requires a minimum of modifications of the compressor in order to attain the adaptation of the balancing force and introduces no movable parts for that. The dimensioning of the parameters in the system such as the area of the balancing piston and the degree of throttling of the two throttles can be easily calculated for an expected pressure variation range, and due to the simplicity of the system the risk for failure is minimized.

Since the liquid injection means normally represents a throttling of the liquid when it is injected, the second throttling device advantageously is comprised by the liquid injection means itself.

There is no need to use variable throttling neither in the first nor in the second of the throttling devices so that fixed throttles can be used.

BRIEF DESCRIPTION OF THE DRAWING

The invention will be further explained through the following detailed description of a preferred embodiment thereof and with reference to the accompanying figure which schematically illustrates a compressor according to the invention.

DETAILED DESCRIPTION

The compressor 1, which is of the rotary screw type with a pair of intermeshing screw rotors, has a low pressure inlet 2 and a high pressure outlet 3. One of the rotors is provided with a shaft extension 15 connected to driving means not shown, the shaft extension having a balancing piston 11 in a cylinder 14. The compressor is oil injected and in the outlet pipe 8 there is an oil separator 10. From the oil separator the gas escapes through the delivery pipe 9, and the separated oil flows back to the working space through a pipe 6 and the oil injection means 4. The pipe 6 is provided with a first throttle 5 adjacent to the oil separator, and the oil injection means constitutes a second throttle 4. Between the first 5 and second 4 throttle a branch pipe is connected to the pipe 6, which branch pipe ends in the cylinder 14.

The compressor receives gas through the inlet 2 at an inlet pressure $p_s$, which gas leaves the compressor through the outlet 3 at delivery pressure $p_d$. The pressure $p_i$ in the working space where the oil is injected is intermediate suction pressure $p_s$ and delivery pressure $p_d$. The reduction of the pressure $p_d$ in the oil separator 10 to the injection pressure $p_i$ takes place in the two throttles 5 and 4 in the pipe 6. The balancing pressure $p_b$ acting on pressure surface 12 on the high pressure side of the balancing piston equals the pressure in pipe 6 between the two throttles 5 and 4, which pressure will be higher than $p_i$ but lower than $p_d$. Some oil will leak across the balancing piston 11 to its fight side, which oil is drained along a clearance 15*a* surrounding the shaft extension 15 to the working space 16 of the compressor at a location 16*a* where the working space still communicates with the inlet port so that the pressure $p_a$ is constantly slightly above suction pressure. The relation between the different pressures thus is $p_s<p_a<p_i<p_b<p_d$.

At operation there will be an axial gas force F acting on each rotor in a direction from the high pressure end to the low pressure end of the compressor, i.e. leftwards in the figure, which gas force is a function of $p_s$ and $p_d$. The balancing force $F_b$ from the piston 11 depends on the effective pressure area 12 of the piston and is a function of $p_b$ and $p_a$. The balancing force should be smaller than the gas force and thus leave a resultant force $F_R=F-F_B$ to be taken up by the thrust bearings. It is desirable that the resultant force lies within a certain range $F_{min}<F_R<F_{max}$, where $F_{min}$ and $F_{max}$ are determined by the load requirements of the thrust bearings.

As mentioned the compressor is intended for applications, in which $p_s$ as well as $p_d$ will vary, and with them the gas force F. Varying $p_s$ and $p_d$ also affects $p_b$, so that also the balancing force $F_B$ will vary as a function of $p_s$ and $p_d$, which results in that the gas force F and the balancing force $F_B$ will vary simultaneously.

The characteristic of the variation of the balancing force $F_B$ as a function of $p_s$ and $p_d$ is mainly determined by the relation between the degree of throttling in the respective throttle 5 and 4 and by the location of the liquid injection port.

By a proper dimensioning of the first throttle 5 in relation to the second throttle 4 it is possible to attain such a variation of $p_b$ as a function of $p_s$ and $p_d$ so that the resultant force $F_R$ will remain within the above prescribed range for different running conditions.

The following numerical example illustrates the advantages attained with a compressor according to the invention. The compressor in this example is intended for pumping up natural gases from deep well sources where the pressure may vary between 10 to 35 bars, and the gas is delivered at a pressure varying from 60 to 80 bars. The oil injection port is located in the working chamber at a place where the pressure $p_i=1.7\times p_s$, and the relation between the throttling degree in the two throttles is so selected that the balancing pressure is $p_b=p_i+0.6(p_d-p_i)$. The net balancing pressure on the balancing piston is $p_n=p_b-p_a$, where $p_a$ is about one bar above $p_s$ irrespective of the level of $p_s$. The net balancing pressure thus can be expressed as a function of $p_s$ and $p_d$: $p_n=p_b-p_a=p_b-(p_s+1)=p_i+0.6\times(p_d-p_i)-p_s-1=1.7\ p_s+0.6\ p_d-1.02\ p_s-p_s-1=0.6\ p_d-0.32\ p_s-1$ This pressure acts on a balancing piston surface with an area of A $cm^2$ resulting in a balancing force $F_B=A\times(0.6\ p_d-0.32\ p_s-1)$. As explained above this force should balance the gas force F to such an extent that the remaining load $F_R$ on the thrust beatings falls within a range $F_{min}<F_R<F_{max}$. In this case there is a certain pattern of load fluctuation with time which when set in the range between $F_{min}$=6 000N and $F_{max}$=24 000N gives a calculated beating life of>40 000 h.

In the table below four different running conditions are listed, indicating the gas force F on the male rotor and the corresponding balancing force $F_B$ when the effective pressure area is A $cm^2$. In the right hand column the range for A for which the beating load will fall within the prescribed range is calculated for each case. The units in the tables are bars, N and $cm^2$, respectively.

| | Pd | Ps | F | $F_B$ | A |
|---|---|---|---|---|---|
| 1 | 80 | 10 | 39 000 | A × 438 | 34,2–75,3 |
| II | 80 | 35 | 50 000 | A × 358 | 72,6–123,0 |
| III | 60 | 10 | 31 000 | A × 318 | 22,0–79,6 |
| IV | 60 | 35 | 38 000 | A × 248 | 58,8–134,5 |

From the table it can be seen that for the different cases there is a common range for A between 72,6 and 75,3 $cm^2$, for which the load requirements are met. An appropriate balancing force thus can be attained if the effective pressure area is e.g. 74 $cm^2$.

As mentioned earlier the selection of the location of the oil injection port and of the relative degree of throttling between the two throttles affect the coefficients for $p_b$ as a function of $p_s$ and $p_d$. Thus a modification of the characteristic for $F_B$ is easily attained if this should be necessary in order to fulfil the load requirements when the system is adapted to other applications having other working conditions.

For comparison a corresponding table for a balancing system according to prior art, where the delivery pressure acts directly on the balancing piston is presented below.

| | Pd | Ps | F | $F_B$ | A |
|---|---|---|---|---|---|
| I | 80 | 10 | 39 000 | A × 690 | 21,7–47,8 |
| II | 80 | 35 | 50 000 | A × 440 | 59,0–100,0 |
| III | 60 | 10 | 31 000 | A × 490 | 14,2–51,0 |
| IV | 60 | 35 | 38 000 | A × 240 | 58,3–141,6 |

From the table it can be seen that there exists no value for A that can be used for all cases. If the piston area is dimensioned to properly balance the gas force in one case, the gas force will be over- or underbalanced in others.

I claim:

1. A rotary screw compressor (1) comprising:

a pair of rotors operating in a working space (16) connected to a low pressure inlet port (2) and to a high pressure outlet port (3);

a liquid injector (4) which injects a liquid into said working space at an intermediate pressure level;

a liquid separator (10) connected to said outlet port;

a first pipe (6) including said liquid injector (4), said first pipe (6) connecting said liquid separator (10) to said working space (16) at said intermediate pressure level;

a hydraulic thrust balancing piston (11) acting on at least one of said rotors;

first (5) and second (4) throttling devices in said first pipe (6); and a second pipe (7) connecting a first pressure surface (12) of said piston (11) to said first pipe (6), the connection to said first pipe (6) being located between said first (5) and second (4) throttling devices.

2. A rotary screw compressor according to claim 1, wherein each of said first (5) and second (4) throttling devices comprises a non-variable throttling device.

3. A rotary screw compressor according to claim 2, wherein said liquid injector (4) comprises said second throttling device (4).

4. A rotary screw compressor according to claim 1, wherein said liquid injector (4) comprises said second throttling device (4).

5. A rotary screw compressor according to claim 1, wherein said piston (11) has a second pressure surface (13) axially opposed to said first pressure surface (12), said second pressure surface (13) being connected via a clearance (15*a*) surrounding a shaft extension (15) connecting said piston (11) and said rotor acted upon by said piston (11) to a location (16*a*) of said working space (16) at a second intermediate pressure level, which is lower than said first-mentioned intermediate pressure level.

6. A rotary screw compressor according to claim 2, wherein said piston (11) has a second pressure surface (13) axially opposed to said first pressure surface (12), said second pressure surface (13) being connected via a clearance (15*a*) surrounding a shaft extension (15) connecting said piston (11) and said rotor acted upon by said piston (11) to a location (16*a*) of said working space (16) at a second intermediate pressure level, which is lower than said first-mentioned intermediate pressure level.

7. A rotary screw compressor according to claim 3, wherein said piston (11) has a second pressure surface (13) axially opposed to said first pressure surface (12), said second pressure surface (13) being connected via a clearance (15*a*) surrounding a shaft extension (15) connecting said piston (11) and said rotor acted upon by said piston (11) to a location (16*a*) of said working space (16) at a second intermediate pressure level, which is lower than said first-mentioned intermediate pressure level.

8. A rotary screw compressor according to claim 4, wherein said piston (11) has a second pressure surface (13) axially opposed to said first pressure surface (12), said second pressure surface (13) being connected via a clearance (15*a*) surrounding a shaft extension (15) connecting said piston (11) and said rotor acted upon by said piston (11) to a location (16*a*) of said working space (16) at a second intermediate pressure level, which is lower than said first-mentioned intermediate pressure level.

9. A rotary screw compressor according to claim 1, wherein said piston (11) has a second pressure surface (13) axially opposed to said first pressure surface (12), said second pressure surface (13) being connected to said working space (16) at inlet pressure.

10. A rotary screw compressor according to claim 2, wherein said piston (11) has a second pressure surface (13) axially opposed to said first pressure surface (12), said second pressure surface (13) being connected to said working space (16) at inlet pressure.

11. A rotary screw compressor according to claim 3, wherein said piston (11) has a second pressure surface (13) axially opposed to said first pressure surface (12), said second pressure surface (13) being connected to said working space (16) at inlet pressure.

12. A rotary screw compressor according to claim 4, wherein said piston (11) has a second pressure surface (13) axially opposed to said first pressure surface (12), said second pressure surface (13) being connected to said working space (16) at inlet pressure.

* * * * *

UNITED STATES PATENT AND TRADEMARK OFFICE

CERTIFICATE OF CORRECTION

PATENT NO. :5,678,987

DATED :October 21, 1997

INVENTOR(S) :Karlis TIMUSKA

It is certified that error appears in the above-identified patent and that said Letters Patent is hereby corrected as shown below:

Column 1, line 12, after "known devices", change "an" to --and--; after "normal cases", insert --,--.

Column 2, line 49, change "fight" to --right--.

Column 3, line 39, change "beating" to --bearing--.

Signed and Sealed this

Tenth Day of March, 1998

*Attest:*

*Attesting Officer*

BRUCE LEHMAN

*Commissioner of Patents and Trademarks*